US008740581B2

(12) United States Patent
Nored et al.

(10) Patent No.: US 8,740,581 B2
(45) Date of Patent: Jun. 3, 2014

(54) PRESSURE RECOVERY INSERT FOR RECIPROCATING GAS COMPRESSOR

(75) Inventors: Marybeth G. Nored, San Antonio, TX (US); Klaus Brun, Helotes, TX (US); Danny M Deffenbaugh, San Antonio, TX (US)

(73) Assignee: Southern Gas Association Gas Machinery Research Council, Dallas, TX (US)

( * ) Notice: Subject to any disclaimer, the term of this patent is extended or adjusted under 35 U.S.C. 154(b) by 420 days.

(21) Appl. No.: 12/749,734

(22) Filed: Mar. 30, 2010

(65) Prior Publication Data

US 2011/0243760 A1 Oct. 6, 2011

(51) Int. Cl.
*F04B 39/00* (2006.01)
*F04B 53/00* (2006.01)
*E04F 17/04* (2006.01)

(52) U.S. Cl.
USPC ..... 417/312; 181/224

(58) Field of Classification Search
USPC ..... 417/312; 181/224
See application file for complete search history.

(56) References Cited

U.S. PATENT DOCUMENTS

| | | | | | |
|---|---|---|---|---|---|
| 2,936,041 | A | | 5/1960 | Sharp et al. | |
| 3,396,907 | A | * | 8/1968 | Valbjorn | 417/312 |
| 4,464,720 | A | * | 8/1984 | Agarwal | 701/100 |
| 4,734,011 | A | * | 3/1988 | Hall, Jr. | 417/2 |
| 4,934,482 | A | * | 6/1990 | Herron et al. | 181/224 |
| 5,133,647 | A | * | 7/1992 | Herron et al. | 417/312 |
| 5,173,576 | A | * | 12/1992 | Feuling | 181/247 |
| 5,183,974 | A | * | 2/1993 | Wilhelm et al. | 181/0.5 |
| 5,521,340 | A | * | 5/1996 | Thawani et al. | 181/233 |
| 5,590,688 | A | * | 1/1997 | Pitkanen et al. | 138/39 |
| 5,800,146 | A | * | 9/1998 | Junemann et al. | 417/68 |
| 5,905,233 | A | * | 5/1999 | Gobert | 181/229 |
| 6,105,716 | A | * | 8/2000 | Morehead et al. | 181/255 |
| 6,347,609 | B1 | * | 2/2002 | Bloomer | 123/184.57 |
| 7,549,509 | B2 | * | 6/2009 | Lucas et al. | 181/249 |
| 2003/0136119 | A1 | | 7/2003 | Marks et al. | |
| 2004/0234387 | A1 | * | 11/2004 | Marshall et al. | 417/312 |
| 2006/0237081 | A1 | * | 10/2006 | Lucas et al. | 138/39 |
| 2006/0275158 | A1 | | 12/2006 | Nagao et al. | |
| 2008/0253900 | A1 | * | 10/2008 | Harris et al. | 417/53 |

FOREIGN PATENT DOCUMENTS

EP 1715238 10/2006

OTHER PUBLICATIONS

PCT International Search Report, PCT/US2011/029750, issued Jun. 9, 2011.

* cited by examiner

*Primary Examiner* — Charles Freay
*Assistant Examiner* — Alexander Comley
(74) *Attorney, Agent, or Firm* — Booth Albanesi Schroeder, LLC

(57) ABSTRACT

A method of reducing pulsations in a reciprocating compressor system, the system having nozzles between cylinders and filter bottles of the compressor system, the nozzles attaching at ports of the cylinders and filter bottles. A special insert is designed to be placed in one or more of the nozzle. The insert is generally cylindrical, but has a narrowed throat, a flared inlet end, and a flared outlet end. The insert dimensions, such as the inner diameter of the throat and the distance from the throat to the outlet end are calculated to reduce pulsations as well as provide pressure recovery.

18 Claims, 4 Drawing Sheets

PRESSURE RECOVERY INSERT FOR RECIPROCATING GAS COMPRESSOR

TECHNICAL FIELD OF THE INVENTION

This invention relates to reciprocating compressors for transporting natural gas, and more particularly to a device for reducing pulsations in the compressor system associated with such compressors.

BACKGROUND OF THE INVENTION

To transport natural gas from production sites to consumers, pipeline operators install large compressors at transport stations along the pipelines. Natural gas pipeline networks connect production operations with local distribution companies through thousands of miles of gas transmission lines. Typically, reciprocating gas compressors are used as the prime mover for pipeline transport operations because of the relatively high pressure ratio required. Reciprocating gas compressors may also be used to compress gas for storage applications or in processing plant applications prior to transport.

Reciprocating gas compressors are a type of compressor that compresses gas using a piston in a cylinder connected to a crankshaft. The crankshaft may be driven by an electric motor or a combustion engine. A suction valve in the compressor cylinder receives input gas, which is then compressed by the piston and discharged through a discharge valve.

Reciprocating gas compressors inherently generate transient pulsating flows because of the piston motion and alternating valve motion. Various devices and control methods have been developed to control these pulsations. An ideal pulsation control design reduces system pulsations to acceptable levels without compromising compressor performance.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to a pulsation control device for attenuating pressure pulsations associated with a reciprocating compressor. These pulsations are common in modern high speed reciprocating compressors and can cause significant structural vibrations. The device is particularly useful for reducing cylinder nozzle pulsations, and offers an alternative approach to other pulsation control devices such as orifice plates and Helmholtz resonators.

By "reciprocating compressor" is meant a positive displacement compressor that uses pistons driven by a crankshaft to deliver gases (or other fluids) at high pressure. The compressor typically has more than one compression cylinder. Intake fluid flows into the cylinders where it is compressed by a piston driven in a reciprocating motion via a crankshaft, and is then discharged. The movement into and out of the cylinders is via cylinder intake and discharge valves.

Figure 1:
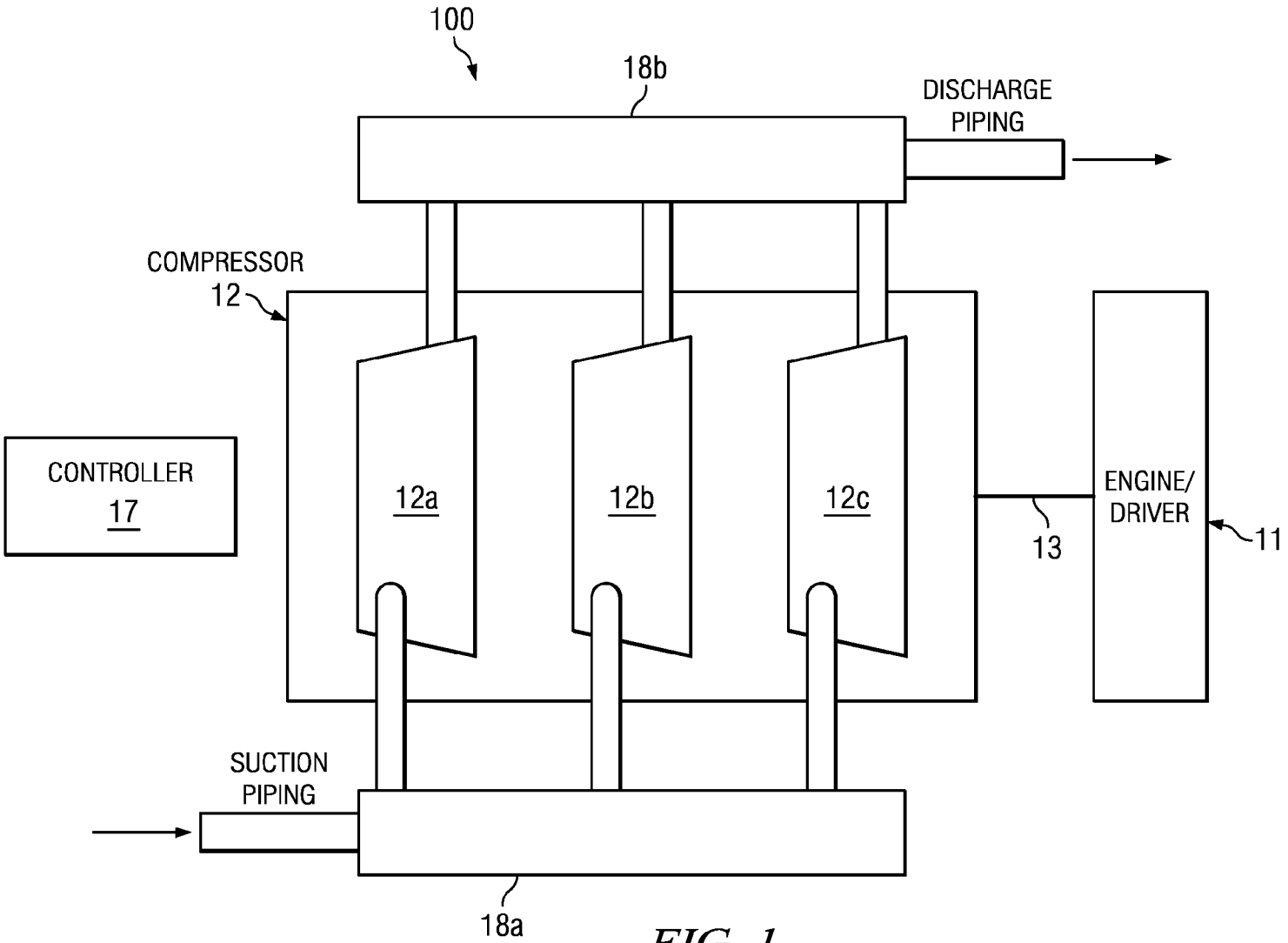
FIG. 1 is a block diagram of a reciprocating gas compressor system.

FIG. 1 is a block diagram of the basic elements of a reciprocating gas compressor system 100. The basic elements of compressor system 100 are depicted as those of a typical or "generic" system, and include a driver 11, compressor 12, suction filter bottle 18*a*, discharge filter bottle 18*b*, and suction and discharge piping connections.

In the example of FIG. 1, compressor 12 has three compressor cylinders 12*a*-12*c*. In practice, compressor 12 may have fewer or more (often as many as six) cylinders. Compressor valves (not explicitly visible in FIG. 1) are installed on each cylinder to permit one-way flow into or out of the cylinder volume.

Compressor 100 may have either an integral or separate engine or motor driver 11. The output of driver (motor or engine) is unloaded through the compressor. The driver 11 is often an internal combustion engine.

The following description is written in terms of the "generic" compressor system 100. However, the same concepts are applicable to other compressor configurations.

A typical application of compressor system 100 is in the gas transmission industry. The compressor system operates as a "station" between two gas transmission lines. The first line, at an initial pressure, is referred to as the suction line. The second line, at the exit pressure for the station, is referred to as the discharge line. The suction and discharge lines are also referred to in the industry as the "lateral piping". The pressure ratio (discharge pressure divided by suction pressure) may vary between 1.25-4.0, depending on the pipeline operation requirements and the application.

Filter bottles 18*a* and 18*b* may be used to reduce compressor system pulsations. These filter bottles are placed between the compressor and the lateral piping, on the suction or discharge side or on both sides.

Controller 17 is used for control of parameters affecting compressor load and capacity. The pipeline operation will vary based on the flow rate demands and pressure variations. The compressor must be capable of changing its flow capacity and load according to the pipeline operation. Controller 17 is equipped with processing and memory devices, appropriate input and output devices, and an appropriate user interface. It is programmed to perform the various control tasks and deliver control parameters to the compressor system. Given appropriate input data, output specifications, and control objectives described herein, algorithms for programming controller 17 may be developed and executed.

Figure 2:
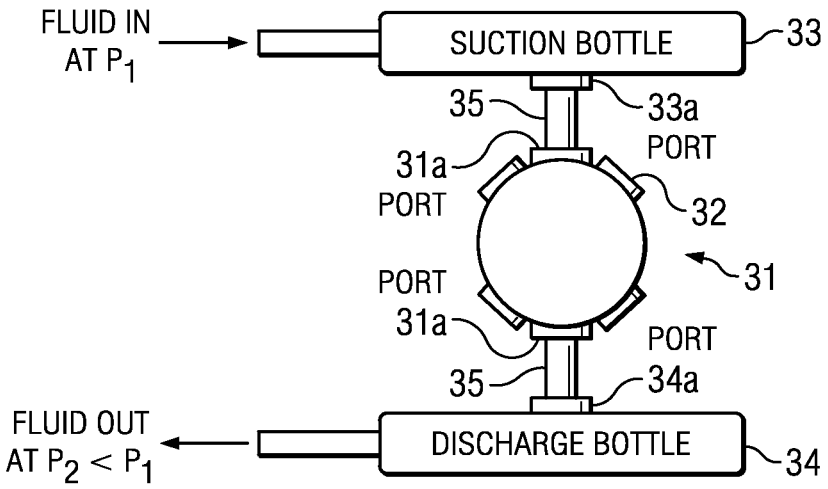
FIG. 2 is a top schematic view of a cylinder with its nozzle connections to filter bottles.

FIG. 2 is a top view of a single cylinder 31, also showing four cylinder valve caps 32. A cylinder "nozzle" 35 is a section of pipe that connects the cylinder 31 to the discharge or suction side of the compressor. Thus, a suction-side nozzle 35 connects the cylinder to the suction piping via a suction-side filter bottle 33. A discharge-side nozzle 35 connects the cylinder to the discharge piping via a discharge-side filter bottle 34.

Each nozzle 35 is attached to the cylinder 31 by means of a cylinder nozzle port 31*a*. Similarly, suction bottle 33 and discharge bottle 34 have nozzle ports 33*a* and 34*a*, respectively, by means of which the nozzle 35 is attached.

Figure 3:
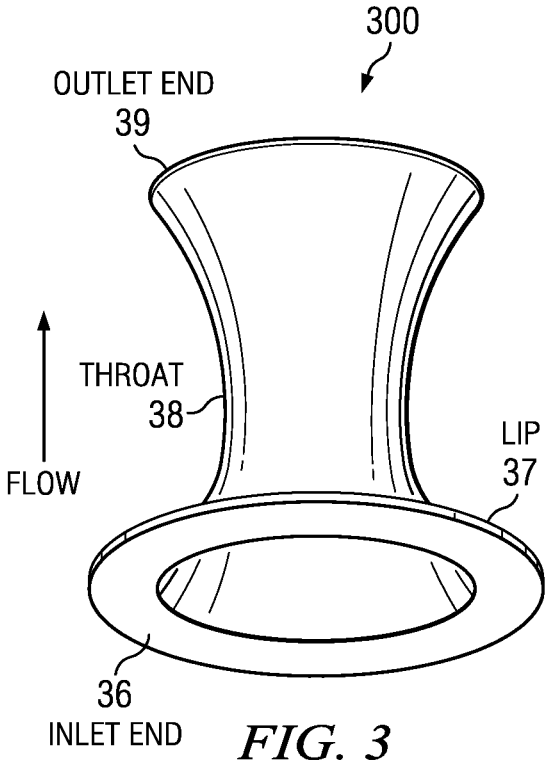
FIG. 3 illustrates a pressure recovery insert in accordance with the invention.

FIG. 3 illustrates pressure recovery insert 300 in accordance with the invention. As explained below, when inserted in a nozzle 35 of a reciprocating compressor, insert 35 reduces pulsation amplitudes and recovers pressure drop. More specifically, pulsation attenuation is achieved by choking the flow at the nozzle, restricting volume flow, and increasing upstream pressure, which causes flow peaks to smooth over time downstream of the nozzle.

In addition, insert 300 is structured to recover pressure in a pulsating flow field. Because of space limitations inside a compressor nozzle, insert 300 is designed to achieve maximum pressure recovery over the shortest distance while also providing pulsation damping. This is achieved using fluid flow analysis for flow path optimization.

Insert 300 is generally cylindrical in shape, but with a narrowed throat 38 and a flare at each end. A lip 37 permits the insert to be inserted into a nozzle fitting connection, as described below in connection with FIG. 4.

The throat 38 of insert 300 has its narrowest diameter. The inner diameter of throat 38 is calculated as a function of the required pulsation attenuation for the specific nozzle resonance.

The diameter of insert 300 continuously and gradually increases from the throat 38 to the inlet and outlet ends. At each end, the insert has a maximum outer diameter that is slightly smaller than the inner diameter of the nozzle 35. This permits insert 300 to fit snugly inside the nozzle.

Lip 37 is at the inlet end of insert 300. It is designed to fit on and around the perimeter of a nozzle fitting flange of a compressor cylinder, as described below in connection with FIG. 4.

The length of insert 300 from throat 38 to outlet end 39 is an "expansion section". The dimensions of this expansion section are designed to recover pressure losses. The length of insert 300 from throat 33 to outlet end 39 and the length of insert 300 from throat 38 to inlet end 37 may be, but are not necessarily the same.

As stated above, fluid flow dynamics calculations are used to calculate the dimensions of insert 300, such as the minimum diameter at throat 38 and the length of expansion section from throat 38 to outlet end 39. As a result of these calculations and of having proper dimensions, insert 300 functions like an orifice but uses a streamlined flow path that provides optimal pressure recovery as well as minimizes pressure fluctuations.

Figure 4:
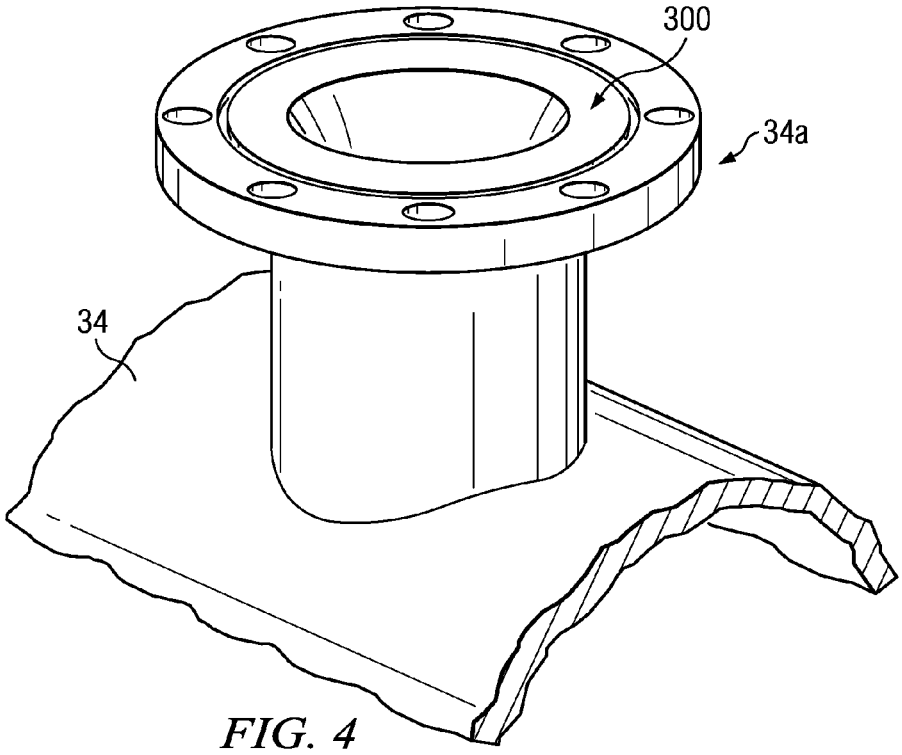
FIG. 4 illustrates the pressure recovery insert installed in a discharge nozzle.

FIG. 4 illustrates insert 300 installed in a discharge nozzle 35. In the example of FIG. 4, insert 300 is installed in the nozzle 35 so that insert 300 is held in place between a flange of the nozzle fitting and a flange of port 31*a* (not shown). As is standard in such fittings, each flange has bolt holes for bolting the flanges together, thereby securing the nozzle 35 to a port. Thus, referring again to FIGS. 2 and 3, the flow is out of cylinder 31 and into nozzle 35. Lip 37 is on the upstream side (facing) the flow of gas (or other fluid).

For suction-side attenuation, insert 300 could be inserted at a suction nozzle, such as at port 31*a* illustrated in FIG. 2. Again, lip 37 is used to hold insert 300 in place between flanges. Again, lip 37 faces the flow, and depending on the configuration of the nozzle fitting at port 31*a*, may or may not be completely enclosed by nozzle piping between the suction bottle and the cylinder.

In other embodiments, insert 300 could be placed in port fittings of other piping locations. For example, as indicated below in connection with FIG. 6, insert 300 could be used at compressor filter bottle ports. Insert 300 could also be used at other station vessels or in other station piping locations.

Figure 5:
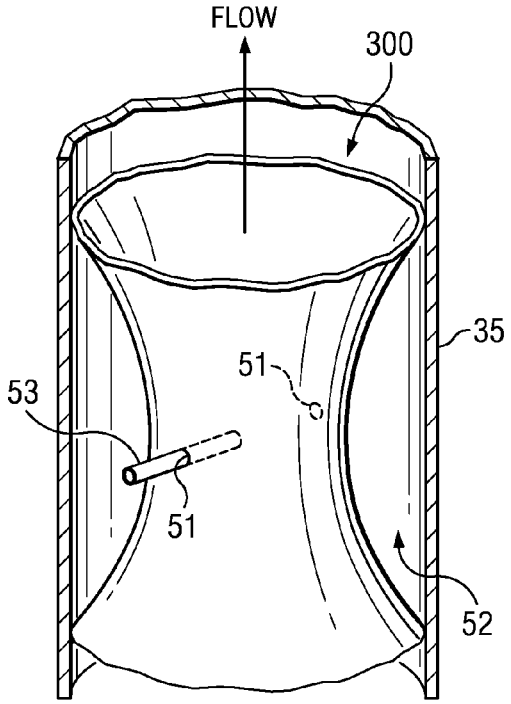
FIG. 5 illustrates the pressure recovery insert installed in a nozzle and having a choke hole leading to a volume between the insert and the nozzle piping.

FIG. 5 illustrates insert 300 in place within a nozzle 35, also illustrating how insert 300 can be combined with a side cavity to provide additional pulsation reduction. More specifically, a small hole 51 may be drilled into the wall of the insert 300. FIG. 5 illustrates two such holes 51. If desired, a choke tube 53 may be inserted into hole 51. The hole (or choke tube) provides fluid communication with a volume 52 between the outer wall of insert 300 and the inner wall of nozzle 35. The dimensions of the hole 51, choke tube 53, and the volume 52 are determined by calculations associated with Helmholz resonators, and are a function of the speed of sound and the desired resonator absorption frequency. Although not shown in FIG. 5, the same concept could be extended to providing fluid communication via port 51 and a longer choke tube 53 to an external volume.

Figure 6:
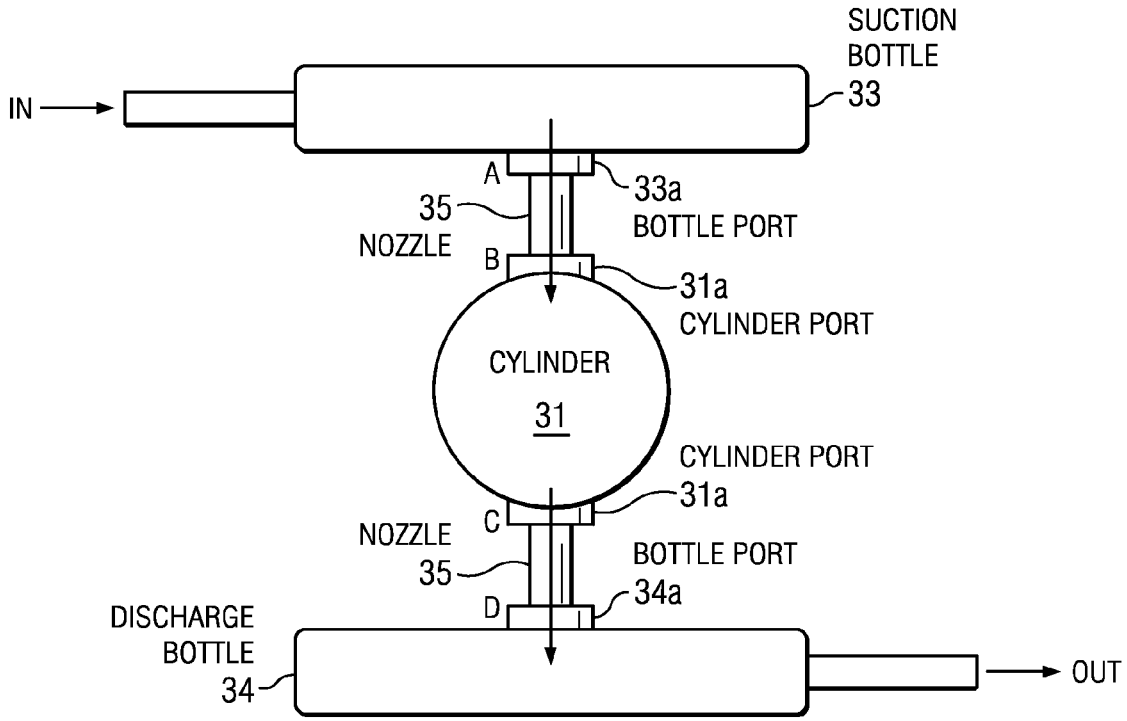
FIG. 6 illustrates possible locations for the insert.

FIG. 6 illustrates various possible locations for placing insert 300 for nozzle pulsation attenuation. These locations are not exclusive, and as stated, above, insert 300 may be used anywhere in the compressor piping.

Four locations, A-D, are identified, with insert 300 being suitable for any of these locations, depending on flange availability. In other words, the location must have a fitting with a flange that permits insert 300 to be placed with proper flow direction as indicated in FIG. 3, i.e., with lip 37 facing (upstream) the flow direction. Locations B and C would be the typical locations, for reducing cylinder nozzle pulsations.

Location C is the location pictured in FIG. 4.

What is claimed is:

1. A method of reducing pulsations associated with the a flow of fluid through a reciprocating compressor system for operating between two gas transmission lines, the method comprising:

(a) Determining an amplitude or a frequency of the pulsations to be reduced in the reciprocating compressor system, the reciprocating compressor system having:

a reciprocating compressor having a plurality of cylinders, a plurality of generally cylindrical connecting conduits, and a plurality of other system elements, and wherein each of the plurality of connecting conduits connects the reciprocating compressor to an other system element;

(b) Calculating dimensions of a pulsation-reducing insert to be placed in a connecting conduit, the pulsation-reducing insert being a tube having a tube wall defining an interior passageway, an inlet and an outlet at opposite ends of the tube, and wherein the tube interior narrows from an inlet inner diameter to a narrowed throat inner diameter, and enlarges from the narrowed throat inner diameter to an outlet inner diameter; wherein the dimensions calculated include the throat inner diameter and an axial distance from the throat to the outlet end of the pulsation-reducing insert;

(c) Placing the pulsation-reducing insert into a connecting conduit of the reciprocating compressor system such that the inlet end is upstream of the outlet end of the pulsation-reducing insert; and (d) Attaching the connecting conduit having the pulsation-reducing insert therein to the reciprocating compressor or one of the plurality of other system element; and (e) boring a hole through the tube wall of the insert, the hole fluidly connecting the interior of the tube to an annular space defined between the insert and the connecting conduit, such that the annular space between the insert and the connecting conduit further attenuates pulsations.

2. The method of claim 1, further comprising the step of placing a choke tube in the hole extending through the tube wall of the insert.

3. The method of claim 1, wherein the plurality of other system elements includes filter bottles connected to the reciprocating compressor by connecting conduits, and wherein the step of placing the pulsation-reducing insert into a connecting conduit further comprises the step of placing the pulsation-reducing insert into a connecting conduit extending between a filter bottle and the reciprocating compressor.

4. The method of claim 3, wherein the step of placing the pulsation-reducing insert into a connecting conduit further comprises placing the insert into a connecting conduit extending between a filter bottle and a cylinder of the reciprocating compressor.

5. The method of claim 1, wherein the reciprocating compressor defines a suction side and a discharge side, and wherein the step of placing the pulsation-reducing insert further comprises the step of placing the insert on the discharge side of the reciprocating compressor.

6. The method of claim 1, wherein the pulsation-reducing insert further comprises a lip extending radially outward from the inlet end of the tube, and further comprising the step of maintaining the pulsation-reducing insert in position in the connecting conduit using the lip.

7. The method of claim 1, wherein the step of attaching the connecting conduit further includes the step of attaching the connecting conduit using a radially outwardly extending flange having bolt holes therethrough.

8. The method of claim 1, further comprising the step of fluidly connecting the interior space defined in the pulsation-reducing insert to a space defined exterior to the pulsation-reducing insert.

9. The method of claim 8, wherein the space defined exterior to the pulsation-reducing insert is exterior to the connecting conduit.

10. A method of reducing pulsations associated with a flow of fluid through an existing reciprocating compressor system operating between two gas transmission lines, the method comprising:

(a) determining a characteristic of the pulsations to be reduced;

(b) based on the determined characteristic, calculating preferred dimensions of a pulsation-reducing insert to be placed in a connecting conduit of the reciprocating compressor system;

(c) positioning the pulsation-reducing insert into a connecting conduit extending between elements of the reciprocating compressor system, the pulsation-reducing insert having a generally cylindrical wall defining an interior passageway, the interior passageway open at both ends, the insert having a minimum inner diameter at an insert throat positioned between radially outwardly flared inlet and outlet sections of the insert, the pulsation-reducing insert having at least one hole defined extending through the generally cylindrical wall, and the step of fluidly connecting the interior passageway of the insert to an annular space defined between the insert and the connecting conduit in which it is positioned; and (d) attaching the connecting conduit, with the pulsation-reducing insert positioned therein, to an element of the reciprocating compressor system.

11. The method of claim 10, wherein step (b) further comprises calculating a preferred throat inner diameter of the pulsation-reducing insert and a preferred axial distance between the throat and an outlet end of the pulsation-reducing insert.

12. The method of claim 10, wherein step (c) further comprises positioning the pulsation-reducing insert in a connecting conduit extending between a reciprocating compressor of the reciprocating compressor system and a filter bottle of the reciprocating compressor system.

13. The method of claim 12, wherein step (c) further comprises positioning the pulsation-reducing insert in a connecting conduit extending between a cylinder of the reciprocating compressor and a filter bottle of the reciprocating compressor system.

14. The method of claim 12, wherein step (c) further comprises positioning the pulsation-reducing insert in a connecting conduit extending between the reciprocating compressor and an element of the reciprocating compressor system positioned on a discharge side of the reciprocating compressor.

15. The method of claim 12, wherein step (c) further comprises positioning the pulsation-reducing insert in a connecting conduit extending between a reciprocating compressor of the reciprocating compressor system and a filter bottle of the reciprocating compressor system.

16. The method of claim 10, wherein step (d) further comprises attaching the connecting conduit, with the pulsation-reducing insert positioned therein, to an element of the reciprocating compressor system via a flange having bolt holes extending therethrough.

17. The method of claim 10, further comprising the step of (e) maintaining the pulsation-reducing insert in position in a connecting conduit using a radially outwardly extending lip of the insert.

18. The method of claim 10, wherein step (a) further comprises determining a frequency, amplitude or other characteristic of the pulsations to be reduced.

* * * * *